United States Patent [19]

Ross

[11] Patent Number: 4,864,921

[45] Date of Patent: Sep. 12, 1989

[54] COMBINATION MUG WITH INTEGRAL TEA BAG RECEPTACLE

[76] Inventor: Gary Ross, 112 Ventura Ave., Oxnard, Calif. 93035

[21] Appl. No.: 248,972

[22] Filed: Sep. 26, 1988

[51] Int. Cl.[4] ..... A47J 31/00; A47J 31/18; F47G 19/22

[52] U.S. Cl. ..... 99/279; 99/319; 215/6; 206/0.5

[58] Field of Search ..... 215/6; 206/0.5; 99/279, 99/295, 316, 317, 319, 322, 323; 426/79, 82

[56] References Cited

U.S. PATENT DOCUMENTS

| | | | |
|---|---|---|---|
| D. 49,189 | 6/1916 | Leachman | 215/6 X |
| D. 277,354 | 1/1985 | Levine | 215/6 X |
| 678,720 | 7/1901 | Cochrane | 99/295 X |
| 1,652,935 | 12/1927 | Goldfield | 99/317 |
| 1,748,297 | 2/1930 | Matson | 99/317 |
| 1,879,654 | 9/1932 | Blakeslee | 99/321 X |
| 2,323,468 | 7/1943 | Hevers | 99/295 |
| 2,328,599 | 9/1943 | Armstrong | 99/319 X |
| 2,591,606 | 4/1952 | Reed | 99/316 |
| 3,657,994 | 4/1972 | Post | 99/323 |
| 3,861,284 | 1/1975 | Costello | 99/323 X |

FOREIGN PATENT DOCUMENTS

| | | | |
|---|---|---|---|
| 9215 | of 1911 | United Kingdom | 99/316 |

*Primary Examiner*—Sue A. Weaver
*Attorney, Agent, or Firm*—Thomas I. Rozsa

[57] ABSTRACT

A combination mug and tea bag holder wherein the tea bag holder is an integral part of the mug, to thereby provide a convenient location to store a used tea bag, either for subsequent reuse on a second or subsequent refill or for easy discarding after the user is finished drinking the tea. A transverse receptacle is formed into the upper portion of a mug, which slot opens up into the mug. A tea bag which has been dipped into hot water may be slid by the string attached to the tea bag from the hot water into the transverse receptacle where it can rest until it needs to be subsequently reused or eventually discarded.

20 Claims, 2 Drawing Sheets

Fig. 1.
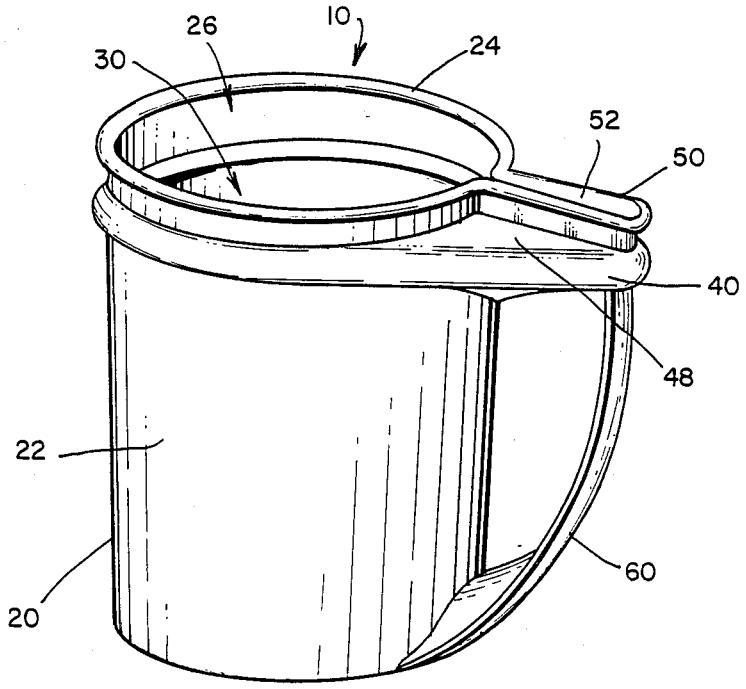
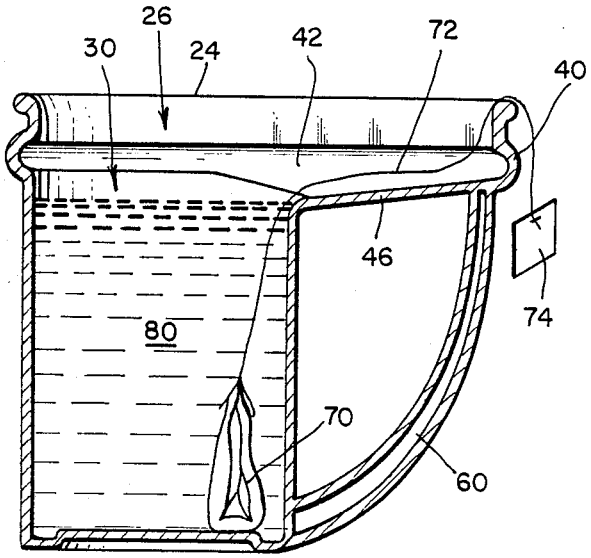
Fig. 2.
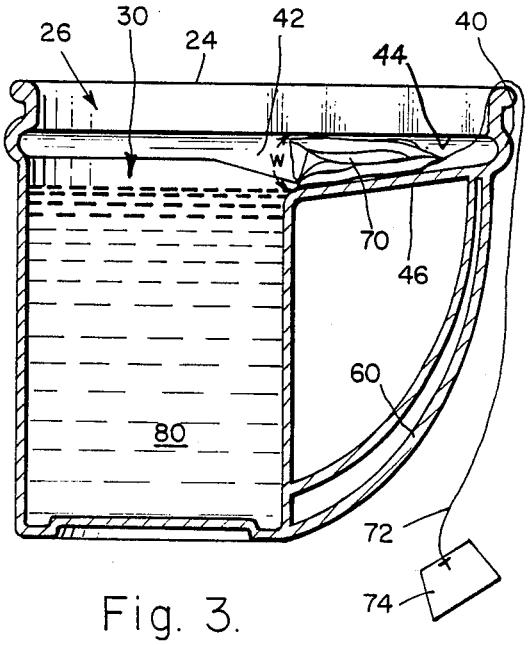
Fig. 3.

COMBINATION MUG WITH INTEGRAL TEA BAG RECEPTACLE

BACKGROUND OF THE INVENTION

1. Field of the Invention

The present invention relates to vessels for holding beverages and in particular hot beverages such as tea. The present invention also relates to the field of tea bag holders which are used to hold a used tea bag after it has been dipped into hot water so that the tea can seep through the bag and into the water.

2. Description of the Prior Art

Hot tea is conventionally drunk from a vessel which may be a cylindrical mug or a cup. Conventionally, a tea bag is first placed in the vessel and hot water is then poured into the vessel to permit the tea to seep through the bag and into the water. After a sufficient amount of tea has seeped through the bag to arrive at the desired darkness or strength of the tea, the tea bag is lifted out of the mug or cup. At this point, a conventional problem arises—namely, what to do with the used tea bag. Sometimes, the user places the tea bag on the saucer on which the cup rests. This presents a problem in that after the user raises the cup to his lip to drink some tea and then replaces the cup on the saucer, he may accidentally place the cup on part of the tea bag resting on the saucer, thereby spilling the tea. To avoid this problem other users take the used tea bag and place it within a napkin. This creates another problem in that the wet used tea bag causes tea to seep through a paper napkin which then seeps onto the table cloth. Users are reluctant to place such a tea bag on a cloth napkin since the tea will stain the cloth napkin and such stain is extremely difficult to remove. In addition, any such disposal method requires the tea bag to be lifted out of the cup or mug and at this time tea which can badly stain a surface is permitted to drip onto the table cloth from the wet tea bag.

Therefore, a major problem exists with what to do with the used tea bag after it has been dipped in hot water. In addition, if the tea bag is placed on the saucer of a cup or within a napkin, or else permitted to rest on the paper tea bag holder in which the tea bag came, the tea bag dries out and cannot be effectively reused. Many people frequently drink the initial cup of tea and then would like a refill. With the conventional way of storing a used tea bag, the tea bag dries out and does not provide a satisfactory second cup of tea.

Therefore, a significant need exists for an apparatus to be used in conjunction with a mug or cup for holding and retaining a used tea bag such that it does not create a mess or a problem and further such that the tea bag remains fresh in order to provide a fresh second or third cup of tea.

SUMMARY OF THE PRESENT INVENTION

The present invention relates to a combination mug and tea bag holder wherein the tea bag holder is an integral part of the mug, to thereby provide a convenient location to store a used tea bag, either for subsequent reuse on a second or subsequent refill or for easy discarding after the user is finished drinking the tea.

It has been discovered, according to the present invention, that if a transverse receptacle is formed into the upper portion of a mug, which slot opens up into the mug, then a tea bag which has been dipped into hot water may be slid by the string attached to the tea bag from the hot water into the transverse receptacle where it can rest until it needs to be subsequently reused or eventually discarded. If it is to be reused, the tight transverse receptacle holds the tea bag warm and fresh, thereby permitting it to provide a fresh cup of tea on the subsequent reuse. The tea bag need merely be slid by its string from the slot into the new hot water and remain there until the user removes the tea bag back into the transverse receptacle.

It has further been discovered, according to the present invention, that if a mug contains a transverse receptacle which rests above the hot water line, the tea bag retained in the transverse receptacle will not seep additional tea into the water.

It has additionally been discovered, according to the present invention, that if the transverse receptacle is laterally disposed, it can be formed as the top of the handle by which the mug is held and can be formed adjacent the top of the mug such that the maximum amount of mug capacity can be used for the hot water of the tea.

It has also been discovered, according to the present invention, that if the transverse receptacle is longitudinally disposed, it can also be formed as a part of the top of the handle and provide a broad sideways surface by which the mug can be held in addition to being held by the handle.

It is therefore an object of the present invention to provide a receptacle for a used tea tag which is integrally formed with a cup or mug such that the receptacle opens into the cup or mug to permit the tea bag to be removed directly from the hot water into the receptacle without lifting the used tea bag out of the cup.

It is a further object of the present invention to provide a combination mug or cup and used tea bag receptacle which permits the used tea bag to remain in a freah state for subsequent reuse during a refill.

It is an additional object of the present invention to provide a convenient receptacle for a used tea bag which permits the tea bag to be maintained for reuse or maintained to be subsequently discarded without the necessity of lifting the tea bag out of the cup and spilling tea on the table surface and further without the necessity of providing a disposal source such as a napkin to hold the tea bag.

It is another object of the present invention to provide a receptacle for holding a used tea bag which is integral with a tea cup or mug and which does not interfere with the quantity of tea being placed in the mug.

It is a further object of the present invention to provide a tea bag receptacle which can be formed as a portion of the handle of a cup or mug to facilitate holding the cup or mug in addition to acting as a receptacle for the tea bag.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a perspective view of the preferred embodiment of the present invention combination mug with integral tea bag receptacle.

FIG. 2 is a cross-sectional view of the preferred embodiment of the present invention combination mug with integral tea bag receptacle, with the mug filled with water and the tea bag dipped into the water.

FIG. 3 is a cross-sectional view of the preferred embodiment of the present invention combination mug with integral tea bag receptacle with the tea bag removed from the water and inserted into the integral receptacle.

DETAILED DESCRIPTION OF THE PREFERRED EMBODIMENT

Figure 4:
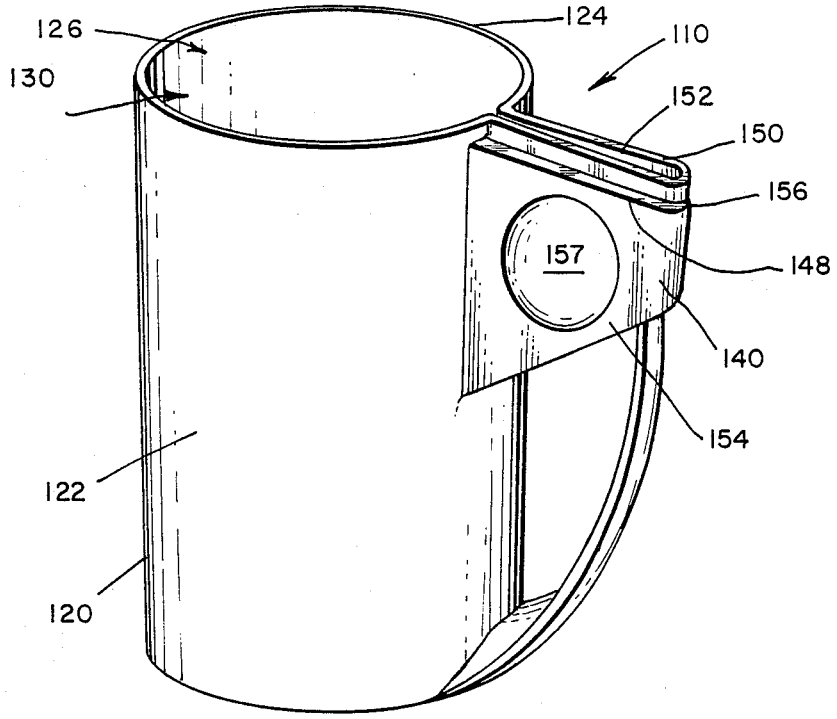
FIG. 4 is a perspective view of an alternative embodiment of the present invention combination mug with integral tea bag receptacle.
Figure 5:
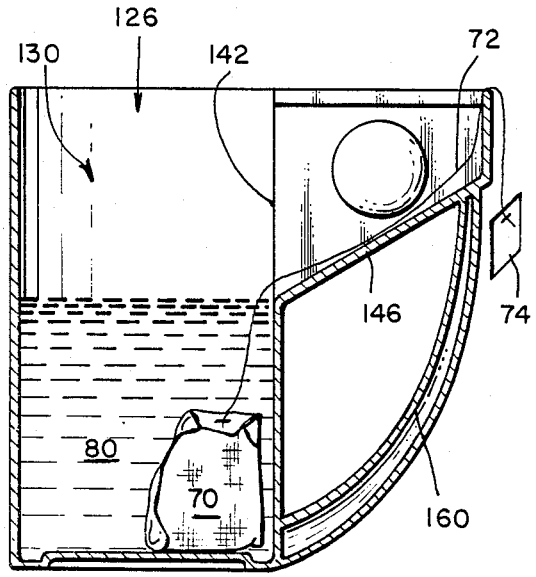
FIG. 5 is a cross-sectional view of an alternative embodiment of the present invention combination mug with integral tea bag receptacle, with the mug filled with water and the tea bag dipped into the water.
Figure 6:
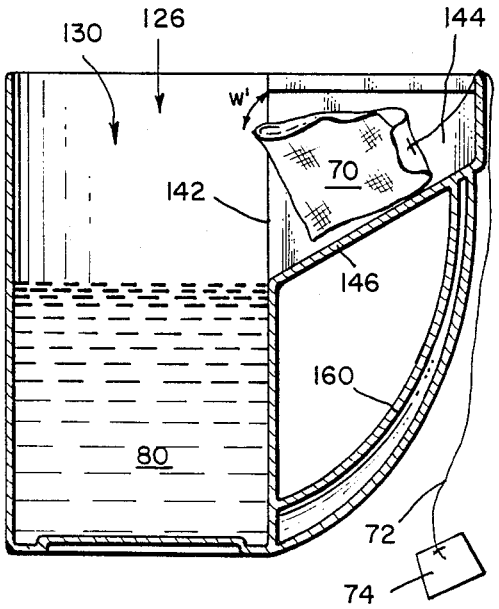
FIG. 6 is a cross-sectional view of an alternative embodiment of the present invention combination mug with integral tea bag receptacle with the tea bag removed from the water and inserted into the integral receptacle.

Although specific embodiments of the invention will now be described with reference to the drawings, it should be understood that such embodiments are by way of example only and merely illustrative of but a small number of the many specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIG. 1, there is shown at 10 the preferred embodiment of the present invention combination mug with integral tea bag receptacle. The combination mug 10 comprises a generally cylindrical body 20 having an exterior cylindrical wall 22 and a top lip 24 surrounding an opening 26 which leads to the internal liquid retaining chamber 30.

Adjacent the top lip 24 and extending transversely from a portion of the cylindrical wall 22 is the tea bag receptacle 40. Extending beneath the tea bag receptacle 40 is the mug handle 60 which extends from beneath the tea bag receptacle 40 to a location on the cylindrical wall 22. It will be appreciated that the handle 60 can be attached to any portion of the receptacle 40.

Referring to the cross-sectional view of FIG. 2, it can be seen that the tea bag receptacle 40 is integrally formed with the cylindrical wall 22 and has an opening 42 wherein the tea bag receptacle 40 extends into the internal liquid retaining chamber 30 of the mug 10. Therefore, the internal liquid retaining chamber 30 is in liquid communication and fluid communication with the interior chamber 44 of tea bag receptacle 40. As illustrated in the cross-sectional view of FIG. 3, the tea bag receptacle 40 is dimensioned so that the interior chamber 44 is just slightly wider than the tea bag on dimension "W" so as to accommodate one conventional tea bag. As illustrated in FIGS. 2 and 3, the bottom wall 46 of tea bag receptacle 40 is sloped upwardly while the top wall 48 of tea bag receptacle 40 is horizontally disposed. As a result, the interior chamber 44 becomes progressively narrower as it extends outwardly from the circumferential wall 22. The top lip 50 of tea bag receptacle 40 is integrally formed with the top lip 24 of mug 10. The top lip 50 contains an interior slot 52 which opens into the interior chamber 44 of tea bag receptacle 40.

In use, a tea bag 70 which is attached to a string 72 which is in turn attached to a paper base 74 is placed into the combination mug 10 such that the tea bag 70 lies within the internal liquid chamber 30 while the string 72 extends into the interior chamber 44 of tea bag receptacle 40 and up and out through slot 52 of the top lip 50 of the tea bag receptacle 40. The paper base 74 hangs outside the mug 10, adjacent the handle 60. The internal liquid retaining chamber 30 of combination mug 10 is then filled with water 80 to a level just below the bottom wall 46 of tea bag receptacle 40. The tea bag 70 is permitted to steep in the hot water 80—until the water becomes sufficiently saturated with tea such that the desired strength and darkness has been achieved. The string 72 is then pulled further out through slot 52 such that the tea bag 70 rises through the water 80 and into the interior chamber 44 of tea bag receptacle 40, as shown in FIG. 3. It will be appreciated that as the interior chamber 44 narrows, it causes tea bag 70 to be squeezed so that excess water is squeezed out of the tea bag and goes into the water 80 which is inside liquid chamber 30 of mug 10.

In this manner, the tea bag 40 is above the water 80 and will not cause the water to become further saturated with tea. Since the tea bag 70 is also off to one side within the tea bag receptacle 40, the user can drink the tea water 80 without the water coming in contact with the tea bag 70. Since the tea bag has been squeezed fairly dry, it will remain fresh for subsequent reuse on the refill after the initial tea water 80 is consumed.

It will be appreciated that FIGS. 1 through 3 disclose the preferred embodiment since the tea bag receptacle 40 is adjacent the top of the mug 10 and above the handle 60. By being adjacent to top of the mug, the tea bag receptacle 40 does not interfere with the mug's capacity to retain a full cup of tea water. By being above the handle, the user can place several fingers around the handle 60 and rest the uppermost finger which surrounds the handle 60 beneath the bottom wall 46 of tea bag receptacle 40, thereby providing extra support. The thumb can also be placed on the top wall 48 or the top lip 50 of the tea bag receptacle 40. This can be achieved since the tea bag receptacle is off to one side of the internal liquid chamber 30 which carries the hot water. Therefore, the tea bag receptacle 40 is not hot.

Through use of the present invention, the tea bag 70 can be retained in the tea bag receptacle 44 without the necessity of lifting the tea bag 70 out of the mug 10 and without the necessity of placing the used tea bag 70 in a napkin, saucer or other place. When it is desired to reuse the tea bag 70, the string 72 is merely guided through the top slot 52 of tea bag receptacle 40 until it extends over the internal liquid retaining chamber 30 and then the tea bag 70 is pulled out of interior chamber 44 and into internal liquid retaining chamber 30. The process of refilling the internal liquid retaining chamber 30 with water and letting the tea bag steep until the water has become saturated with a sufficient amount of tea is repeated. The tea bag 70 is then pulled back into the tea bag receptacle 40, as previously described.

Referring particularly to FIG. 4, there is shown at 110 an alternative embodiment of the present invention combination mug with integral tea bag receptacle. The combination mug 110 comprises a generally cylindrical body 120 having an exterior cylindrical wall 122 and a top lip 124 surrounding an opening 126 which leads to the internal fluid containing chamber 130.

Adjacent the top lip 124 and extending transversely from a portion of the cylindrical wall 122 and extending longitudinally for a portion of the cylindrical wall 122 is the tea bag receptacle 140. Extending beneath the tea bag receptacle 140 is the mug handle 160 which extends from beneath the tea bag receptacle 140 to a location on the cylindrical wall 122. It will be appreciated that the handle 160 can be attached to any portion of the receptacle 140.

Referring to the cross-sectional view of FIG. 2, it can be seen that the tea bag receptacle 140 is integrally formed with the cylindrical wall 122 and has an opening 142 wherein the tea bag receptacle 140 extends into the internal liquid retaining chamber 130 of the mug 110. Therefore, the internal liquid retaining chamber 130 is in liquid communication and fluid communication with the interior chamber 144 of tea bag receptacle 140. As illustrated in the cross-sectional view of FIG. 3, the tea bag receptacle 140 is dimensioned so that the interior chamber 144 is just slightly wider than the tea bag on dimension "W'" so as to accommodate one conventional tea bag. As illustrated in FIGS. 2 and 3, the bottom wall 146 of tea bag receptacle 140 is sloped upwardly while the top wall 148 of tea bag receptacle 140 is horizontally disposed. In addition, the side walls 154 and 156 contain dimples, one of which 157 is shown, which further narrow the width of the interior chamber 144. As a result, the interior chamber 144 becomes progressively narrower as it extends outwardly from the circumferential wall 122. The top lip 150 of tea bag receptacle 40 is integrally formed with the top lip 124 of mug 110. The top lip 150 contains an interior slot 152 which opens into the interior chamber 144 of tea bag receptacle 140.

In use, a tea bag 70 which is attached to a string 72 which is in turn attached to a paper base 74 is placed into the combination mug 110 such that the tea bag 70 lies within the internal liquid retaining chamber 130 while the string 72 extends into the interior chamber 144 of tea bag receptacle 140 and up and out through slot 152 of the top lip 150 of the tea bag receptacle 140. The paper base 74 hangs outside the mug 110, adjacent the handle 160. The internal liquid retaining chamber 130 of combination mug 110 is then filled with water 80 to a level just below the bottom wall 146 and innermost portions of sidewalls 154 and 156 of tea bag receptacle 140. The tea bag 70 is permitted to steep in the hot water 80—until the water becomes sufficiently saturated with tea such that the desired strength and darkness has been achieved. The string 72 is then pulled further out through slot 152 such that the tea bag 70 rises through the water 80 and into the interior chamber 144 of tea bag receptacle 140, as shown in FIG. 3. It will be appreciated that as the interior chamber 144 narrows, it causes tea bag 70 to be squeezed so that excess water is squeezed out of the tea bag and goes into the water 80 which is inside liquid retaining chamber 130 of mug 10.

In this manner, the tea bag 70 is above the water 80 and will not cause the water to become further saturated with tea. Since the tea bag 70 is also off to one side within the tea bag receptacle 140, the user can drink the tea water 80 without the water coming in contact with the tea bag 70. Since the tea bag has been squeezed fairly dry, it will remain fresh for subsequent reuse on the refill after the initial tea water 80 is consumed.

By being above the handle, the user can place several fingers around the handle 160 and rest the uppermost finger which surrounds the handle 160 beneath the bottom wall 146 of tea bag receptacle 140, thereby providing extra support. The thumb can also be placed on the top wall 148 or the top lip 150 of the tea bag receptacle 140. This can be achieved since the tea bag receptacle is off to one side of the internal liquid chamber 130 which carries the hot water. Therefore, the tea bag receptacle 140 is not hot.

One disadvantage of the alternative embodiment is that since the tea bag receptacle is vertically oriented, it occupies a greater space on the interior wall of internal liquid retaining chamber 130 and if the water is to be below the tea bag, only a portion of the internal liquid retaining chamber 130 can be used, as shown in FIGS. 2 and 3.

Through use of the present invention, the tea bag 70 can be retained in the tea bag receptacle 140 without the necessity of lifting the tea bag 70 out of the mug 110 and without the necessity of placing the used tea bag 70 in a napkin, saucer or other place. When it is desired to reuse the tea bag 70, the string 72 is merely guided through the top slot 154 of tea bag receptacle 140 until it extends over the internal liquid retaining chamber 130 and then the tea bag 70 is pulled out of interior chamber 144 and into internal liquid retaining chamber 130. The process of refilling the internal liquid retaining chamber 130 with water and letting the tea bag steep until the water has become saturated with a sufficient amount of tea is repeated. The tea bag 70 is then pulled back into the tea bag receptacle 140, as previously described.

While the invention has been described in conjunction with a mug, it will be appreciated that the present invention can be used in combination with any type of liquid retaining apparatus such as a cup, plastic glass, etc. Therefore, defined more broadly, the present invention is an apparatus for retaining a liquid and a tea bag comprising:

a. a liquid retaining apparatus;

b. a receptacle integrally formed with the liquid retaining apparatus;

c. said liquid retaining apparatus having an internal liquid retaining chamber; and d. said receptacle extending transversely to the internal liquid retaining chamber, the receptacle further comprising an interior chamber opening into the internal liquid retaining chamber;

e. whereby a liquid can be retained in the internal liquid retaining chamber and a tea bag can be retained in the interior chamber of the transverse receptacle.

Said liquid retaining apparatus can be elongated and have an exterior wall surrounding said internal liquid retaining chamber. In addition, said receptacle can be located adjacent the uppermost part of the liquid retaining apparatus and is integrally formed with the exterior wall.

In the preferred embodiment, said receptacle is horizontally disposed relative to the exterior wall and relative to the internal liquid retaining chamber such that the tea bag can be inserted into the interior chamber of the receptacle to thereby permit the internal liquid retaining chamber to be filled with liquid to adjacent the top of the liquid retaining apparatus without coming in contact with the tea bag.

The preferred embodiment may further comprise:

a. a top lip on said receptacle, which top lip surrounds an interior slot extending into the interior chamber of the receptacle;

b. whereby the tea bag may be pulled from the internal liquid retaining chamber into the interior chamber of the receptacle by a string attached to the tea bag and the string may extend through the slot and outside the liquid retaining apparatus.

The liquid retaining apparatus has a top lip on its exterior wall and said top lip on said receptacle is integrally formed with the top lip of said liquid retaining apparatus.

A handle which is attached to said receptacle and also attached to a portion of the exterior wall of the liquid retaining apparatus.

The interior chamber of the receptacle becomes narrower as it extends away from the exterior wall of the liquid retaining apparatus.

In the alternative embodiment:

a. said liquid retaining apparatus is elongated and has an exterior wall surrounding said internal liquid retaining chamber; and b. said receptacle is longitudinally disposed for a portion of the length of the elongated liquid retaining apparatus and extends from adjacent the uppermost part of the liquid retaining apparatus for a distance along the exterior wall, and is integrally formed with the exterior wall.

The alternative embodiment further comprises:

a. a top lip on said receptacle, which top lip surrounds an interior slot extending into the interior chamber of the receptacle;

b. whereby the tea bag may be pulled from the internal liquid retaining chamber into the interior chamber of the receptacle by a string attached to the tea bag and the string may extend through the slot and outside the liquid retaining apparatus.

The liquid retaining apparatus has a top lip on its exterior wall and the top lip on said receptacle is integrally formed with the top lip of said liquid retaining apparatus.

A handle is attached to the receptacle and also attached to a portion of the exterior wall of the liquid retaining apparatus.

The interior chamber of the receptacle becomes narrower as it extends away from the exterior wall of the liquid retaining apparatus.

In either embodiment, the mug can be made of any suitable material. Porcelain or china are the preferred materials, but plastic can also be used. While the mugs in each embodiment have been shown as cylindrical, other shapes commonly used for cups and other liquid containers can also be embodied in the present invention.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for retaining a liquid and a tea bag, comprising:

a. a liquid retaining apparatus;

b. said liquid retaining apparatus having an internal liquid retaining chamber;

c. said liquid retaining apparatus is elongated and has an exterior wall surrounding said internal liquid retaining chamber;

d. a receptacle integrally formed with and extending radially outward from the exterior wall of the liquid retaining apparatus, and extending transversely to the internal liquid retaining chamber, the receptacle further comprising an interior chamber opening into the internal liquid retaining chamber;

e. said receptacle further comprising a lower wall offset at a downwardly extending angle relative to said liquid retaining chamber so that liquid can drain from said receptacle into said liquid retaining chamber;

f. said receptacle further comprising sidewalls and a top wall which in conjunction with the lower wall can retain a tea bag therein such that the tea bag cannot fall out when liquid is drunk from the apparatus; and g. said interior chamber of said receptacle being slightly larger than a conventional tea bag at the location of the intersection of the opening of the interior chamber and the liquid retaining chamber, and the interior chamber of the receptacle becomes narrower as it extends away from the exterior wall of the liquid retaining apparatus;

h. whereby a liquid can be retained in the internal liquid retaining chamber and a tea bag can first be inserted into the liquid and then pulled from the liquid retaining chamber into the interior chamber of the receptacle such that the tea bag does not need to be lifted out of the apparatus and further as the tea bag is pulled into the interior chamber of the receptacle, the progressively narrower chamber causes the tea bag to be squeezed causing the excess retained liquid to be squeezed out of the tea bag and the downwardly sloping lower wall of the interior chamber of the receptacle permits the excess liquid to drain back into the liquid retaining chamber, and the top wall, lower wall and sidewalls of the receptacle securely retain the tea bag within the receptacle.

2. An apparatus in accordance with claim 1 wherein said receptacle is located adjacent the uppermost part of the liquid retaining apparatus.

3. An apparatus in accordance with claim 2 wherein said receptacle is horizontally disposed relative to the exterior wall and relative to the internal liquid retaining chamber such that the tea bag can be inserted into the interior chamber of the receptacle to thereby permit the internal liquid retaining chamber to be filled with liquid to adjacent the top of the liquid retaining apparatus without coming in contact with the tea bag.

4. An apparatus in accordance with claim 3 further comprising:

a. a top lip on said receptacle, which top lip surrounds an interior slot extending into the interior chamber of the receptacle;

b. whereby the tea bag may be pulled from the internal liquid retaining chamber into the interior chamber of the receptacle by a string attached to the tea bag and the string may extend through the slot and outside the liquid retaining apparatus.

5. An apparatus in accordance with claim 4 wherein said liquid retaining apparatus has a top lip on its exterior wall and said top lip on said receptacle is integrally formed with the top lip of said exterior wall.

6. An apparatus in accordance with claim 3 further comprising a handle which is attached to said receptacle and also attached to a portion of the exterior wall of the liquid retaining apparatus.

7. An apparatus in accordance with claim 1 wherein said receptacle is longitudinally disposed for a portion of the length of the elongated liquid retaining apparatus and extends from adjacent the uppermost part of the liquid retaining apparatus for a distance along the exterior wall.

8. An apparatus in accordance with claim 7 further comprising:

a. a top lip on said receptacle, which top lip surrounds an interior slot extending into the interior chamber of the receptacle;

b. whereby the tea bag may be pulled from the internal liquid retaining chamber into the interior chamber of the receptacle by a string attached to the tea bag and the string may extend through the slot and outside the liquid retaining apparatus.

9. An apparatus in accordance with claim 8 wherein said liquid retaining apparatus has a top lip on its exterior wall and the top lip on said receptacle is integrally formed with the top lip of said exterior wall.

10. An apparatus in accordance with claim 7 further comprising a handle which is attached to the receptacle and also attached to a portion of the exterior wall of the liquid retaining apparatus.

11. An apparatus for retaining a liquid and a tea bag, comprising:

a. a mug;

b. said mug having an internal liquid retaining chamber;

c. said mug is elongated and has an exterior wall surrounding said internal liquid retaining chamber;

d. a receptacle integrally formed with and extending radially outward from the exterior wall of the mug, and extending transversely to the internal liquid retaining chamber, the receptacle further comprising an interior chamber opening into the internal liquid retaining chamber;

e. said receptacle further comprising a lower wall offset at a downwardly extending angle relative to said liquid retaining chamber so that liquid can drain from said receptacle into said liquid retaining chamber;

f. said receptacle further comprising sidewalls and a top wall which in conjunction with the lower wall can retain a tea bag therein such that the tea bag cannot fall out when liquid is drunk from the mug; and g. said interior chamber of said receptacle being slightly larger than a conventional tea bag at the location of the intersection of the opening of the interior chamber and the liquid retaining chamber, and the interior chamber of the receptacle becomes narrower as it extends away from the exterior wall of the mug;

h. whereby a liquid can be retained in the internal liquid retaining chamber and a tea bag can first be inserted into the liquid and then pulled from the liquid retaining chamber into the interior chamber of the receptacle such that the tea bag does not need to be lifted out of the apparatus and further as the tea bag is pulled into the interior chamber of the receptacle, the progressively narrower chamber causes the tea bag to be squeezed causing the excess retained liquid to be squeezed out of the tea bag and the downwardly sloping lower wall of the interior chamber of the receptacle permits the excess liquid to drain back into the liquid retaining chamber, and the top wall, lower wall and sidewalls of the receptacle securely retain the tea bag within the receptacle.

12. An apparatus in accordance with claim 11 wherein said receptacle is located adjacent the uppermost part of the mug.

13. An apparatus in accordance with claim 12 wherein said receptacle is horizontally disposed relative to the exterior wall and relative to the internal liquid retaining chamber such that the tea bag can be inserted into the interior chamber of the receptacle to thereby permit the internal liquid retaining chamber to be filled with liquid to adjacent the top of the mug without coming in contact with the tea bag.

14. An apparatus in accordance with claim 13 further comprising:

a. a top lip on said receptacle, which top lip surrounds an interior slot extending into the interior chamber of the receptacle;

b. whereby the tea bag may be pulled from the internal liquid retaining chamber into the interior chamber of the receptacle by a string attached to the tea bag and the string may extend through the slot and outside the mug.

15. An apparatus in accordance with claim 14 wherein said mug has a top lip on its exterior wall and said top lip on said receptacle is integrally formed with the top lip of said exterior wall.

16. An apparatus in accordance with claim 13 further comprising a handle which is attached to said receptacle and also attached to a portion of the exterior wall of the mug.

17. An apparatus in accordance with claim 11 wherein said receptacle is longitudinally disposed for a portion of the length of the mug and extends from adjacent the uppermost part of the mug for a distance along the exterior wall.

18. An apparatus in accordance with claim 17 further comprising:

a. a top lip on said receptacle, which top lip surrounds an interior slot extending into the interior chamber of the receptacle;

b. whereby the tea bag may be pulled from the internal liquid retaining chamber into the interior chamber of the receptacle by a string attached to the tea bag and the string may extend through the slot and outside the mug.

19. An apparatus in accordance with claim 18 wherein said mug has a top lip on its exterior wall and the top lip on said receptacle is integrally formed with the top lip of said exterior wall.

20. An apparatus in accordance with claim 17 further comprising a handle which is attached to the receptacle and also attached to a portion of the exterior wall of the mug.

* * * * *